US005707252A

United States Patent [19]

Meszaros

[11] Patent Number: 5,707,252

[45] Date of Patent: Jan. 13, 1998

[54] SNAP-TOGETHER X-RAY CABLE COUPLING NUT ASSEMBLY

[75] Inventor: James R. Meszaros, Middleboro, Mass.

[73] Assignee: Alden Products Company, Brockton, Mass.

[21] Appl. No.: 541,821

[22] Filed: Oct. 10, 1995

[51] Int. Cl.[6] ..... H01R 13/648

[52] U.S. Cl. ..... 439/610; 439/108

[58] Field of Search ..... 439/610, 320, 439/349, 345, 108, 98, 674, 876, 859

[56] References Cited

U.S. PATENT DOCUMENTS

| | | | |
|---|---|---|---|
| 3,316,524 | 4/1967 | Pastor | 439/320 |
| 3,391,381 | 7/1968 | Livingston | 439/610 |
| 3,789,346 | 1/1974 | De Brick | 439/320 |
| 4,640,569 | 2/1987 | Dola et al. | 439/610 |
| 5,129,837 | 7/1992 | Williams | 439/349 |
| 5,310,361 | 5/1994 | Muchowicz et al. | 439/610 |

*Primary Examiner*—Hien Vu
*Attorney, Agent, or Firm*—Donald W. Meeker

[57] ABSTRACT

A two-piece retainer ring is snap-fit together by protruding roll pins in mating holes forming a self-connected ring around a high-voltage cable engaging a cable plug flange. Parallel spring wires intruding into a central opening of a coupling nut engage an exterior groove in the retainer ring with a snap fit forming an interconnected mutually rotatable coupling nut assembly. A bend relief sleeve between the retainer ring and the cable extends away from the retainer ring along the cable. A ridge around the bend relief sleeve engages an interior groove in the assembled retainer ring. A D-shaped cable plug flange engages a D-shaped plug receptacle opening to align plug contact pins with receptacle sockets. Mating threads on the nut and receptacle secure the plug in the receptacle with an extending sleeve on the retainer ring bearing against the flange. Protruding sloping annular surfaces inside the nut and outside the assembled retainer ring mutually engage to force the retainer ring against the plug flange insuring a tight plug fit and ground continuity between the retainer ring and the flange and between the retainer ring and the nut. Relative motion between the sloping annular surfaces and between the retainer ring and the flange breaks surface oxide enhancing ground continuity.

10 Claims, 1 Drawing Sheet

SNAP-TOGETHER X-RAY CABLE COUPLING NUT ASSEMBLY

BACKGROUND OF THE INVENTION

1. Technical Field

The present invention relates to high-voltage x-ray cable plug couplings and in particular to a two-piece retainer ring snap-fit together and snap-fit rotatably in an annular nut in a shielded plug coupling with a retained bend relief sleeve for connecting an x-ray tube to a high-voltage power source.

2. Description of the Prior Art

X-ray tube equipment requires thick cables and shielded plug assemblies to connect to high-voltage power sources. It is desirable to minimize the size of the cable opening through the wall of the equipment to the diameter of the annular flange protruding from the cable plug. Connecting the cable plug to the plug receptacle inside the wall of the equipment requires an annular nut larger in diameter than the plug flange to slip over the flange after the plug is inserted inside the wall and an additional assemblage contacting the nut to retain the flange securely in place with the plug conducting pins inserted in the sockets of the x-ray tube plug receptacle.

Prior art couplings provided two-piece retainer rings with various means of securing the pieces of the retainer rings together. U.S. Pat. No. 5,310,361 provides a boot over a cable jacket having a protruding flange. Annular grooves around the boot receive a two-piece retainer ring held together by a split ring around the retainer ring. A nut engages the retainer ring. Assembling the split ring and fitting the split ring around it is not easy inside the equipment wall and parts may be dropped causing damage to the equipment and lost parts. Binding might occur between the nut and the retainer ring and the retainer ring and the boot as the nut is screwed in place.

U.S. Pat. No. Des. 301,458 shows a two-piece retainer ring also held together by a split ring which must be secured around the retainer ring which is secured around a cone-shaped sleeve. Difficulty of assembly and dropped parts also present problems in this prior art patent. With the metal surfaces of the nut contacting the retainer ring and the metal surfaces of the retainer ring contacting the cone-shaped sleeve, some binding between the elements might occur as the nut is screwed in place.

U.S. Pat. No. 3,316,524 discloses a two-piece retainer ring assembled around a cone-shaped sleeve and screwed to an annular nut. Assembly is even more difficult in this prior art invention because of the many screws which must be attached and which can fall into the equipment. Screwing the retainer ring to the nut secures the two together so that rotating the nut also rotates the retainer ring which may cause binding problems between the retainer rings and the cone-shaped sleeve.

Existing Federal Standard #72 utilizes a two-piece retaining ring held together by a split ring in an external groove. When the split ring is relaxed, electrical instability occurs causing grounding failures. One prior art device attempts to overcome this problem with a screw-together retaining ring with the inherent assembly and loss of parts problems.

There is a need for an x-ray plug coupling assembly which is easier and simpler to assemble and install with less danger of parts falling inside the equipment and with built-in means for rotating the nut freely without binding with the retainer ring or other elements of the coupling, and a need for a retaining ring and nut assembly which maintains electrical stability to insure a proper ground.

DISCLOSURE OF THE INVENTION

The present invention provides a two-piece retainer ring with protruding split roll pins and mating holes in opposing connecting faces of the retainer ring pieces so that the retainer ring snap-fits together and is self-retaining after snapping together around the cable. The retainer ring is quick and easy to assemble with no additional parts needed to secure the retainer ring around the cable plug.

An annular nut has an interior circular opening just slightly larger than the circumference of a D-shaped flange protruding outwardly around the perimeter at the intersection of the plug and cable so that the nut slips over the flange when the plug is inserted in the x-ray equipment casing. A pair of spring wires protrude into the interior circular nut opening on opposing sides to form parallel opposing chords of the interior circular nut opening. An annular groove around the outer perimeter of a distal end of the retainer ring is snap-fit onto the pair of spring wires securing the retainer ring rotatably within the nut. Having a self-securing snap-fit retainer ring which is snap-fit into the nut rotatably provides ease of assembly and eliminates dropping of coupling parts inside the x-ray equipment casing.

When the retainer ring is snap fit into the nut, a protruding sloping annular surface around the exterior of the retainer ring engages a mating protruding sloping annular surface around the interior of the nut so that, upon threading the nut onto the plug socket threads, the sloping annular surfaces mutually engage to exert pressure from the nut through the retainer ring to the flange and also exert a clamping pressure between the two retainer ring pieces to maintain grounding continuity between the two pieces and between the retainer ring and the nut.

The interior circular opening of the retainer ring is just slightly larger than the circumference of the cable diameter, so that when the nut is screwed onto the mating threads on the plug socket, a proximal face of the retainer ring presses against the plug flange to insure that the plug is fully inserted in the socket and to retain the plug in the socket. As the nut is turned, it is free to rotate relative to the retainer ring, so that a wiping action occurs between the sloping annular surfaces of the retainer ring and nut to break surface oxides and enhance ground continuity. Upon tightening, initially there is also some relative rotary motion between a proximally extending sleeve of the assembled retainer ring and the flange also breaking surface oxides and further enhancing ground continuity.

A bend relief sleeve fashioned of rubberized plastic fits within the retainer ring between the retainer ring and the cable and extends distally away from the nut and retainer ring fitting tightly around the cable, so that the cable is restricted from bending adjacent to the nut and retainer ring, thereby preventing the cable from being cut or frayed on the retainer ring.

BRIEF DESCRIPTION OF THE DRAWING

These and other details of my invention will be described in connection with the accompanying drawings, which are furnished only by way of illustration and not in limitation of the invention, and in which drawings.

BEST MODE FOR CARRYING OUT THE INVENTION

Figure 1:
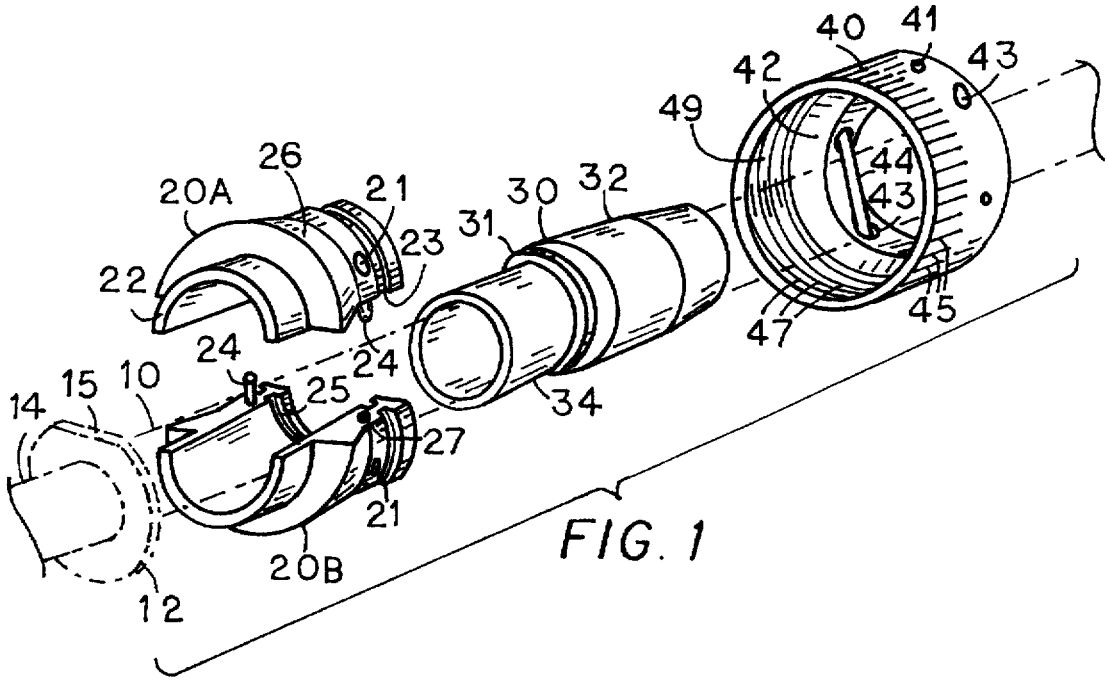
FIG. 1 is an exploded perspective view of the components of the snap-fit nut assembly.
Figure 2:
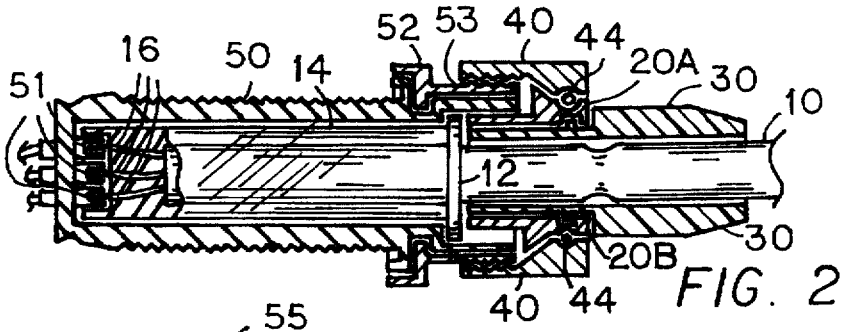
FIG. 2 is a side elevational view in partial section showing the cable and plug end in elevation and the snap-fit nut assembly and the plug receptacle in section.

In FIGS. 1 and 2 a snap-together high-voltage plug coupling nut assembly device for retaining a high voltage cable end plug 14 in a threaded high-voltage plug receptacle 50 with receiving sockets 51 comprises a high-voltage cable 10 having an end plug 14 with conducting end pins 16 insertable in the receiving sockets 51 and a protruding flange 12 between the cable 10 and the end plug 14, a two-piece retainer ring 20A and 20B contacting the flange 12 and having a snap-fit built-in self-retaining means 24 and 27 of securing the two-piece ring together around the cable 10 adjacent to the flange 12, and an annular nut 40 having threads 47 for engaging a mating threaded portion 52 of a metal ring 53 at the opening of the plug receptacle 50, an interior circular opening 49 sufficiently large so that the nut 40 fits over the flange 12, and a means 44 for snap-fitting and securing the retainer ring 20A and 20B rotatably within the nut 40 so that the nut and the retainer ring form a snap-together coupling nut assembly.

The snap-fit built-in self-retaining means of securing the two-piece retainer ring together comprises a roll pin 24 protruding from at least one piece 20A of the two-piece retainer ring inserted in a tight friction snap fit within a mating hole 27 in the other piece 20B of the two-piece retainer ring. Preferably a roll pin 24 and hole 27 in each piece mates with a mating hole 27 and roll pin 24 in each other piece.

The connected retainer ring 20A and 20B further comprises a circular groove 23 around the exterior of the retainer ring and the means for snap-fitting and securing the retainer ring rotatably within the nut comprises a pair of spring wires 44 inserted through opposing sides of the nut 40, through drilled holes 43 angled into the sides of the nut, and protruding into the interior circular opening 49 of the nut so that the spring wires form parallel chords within the circular opening and the spring wires engage the exterior circular groove 23 of the retainer ring with a snap-fit allowing relative rotation of the nut and retainer ring.

A bend relief sleeve 30 is positioned between the retainer ring 20A and 20B and the cable 10 with a distal portion 32 of the bend relief sleeve extending along a portion of the cable 10 away from the retainer ring and a proximal portion 34 of the bend relief sleeve 30 underneath the retainer ring. The assembled retainer ring 20A and 20B further comprises an interior circular groove 25 and the bend relief sleeve further comprises an exterior circular ridge 31 engaging the interior circular groove 25 of the retainer ring so that the bend relief sleeve is secured to the retainer ring.

The retainer ring further comprises, in the connected configuration, a first protruding sloping annular surface 26 around the exterior of the retainer ring and the nut further comprises a second protruding sloping annular surface 42 around the interior of the nut so that the first and second annular surfaces mutually engage to exert pressure from the nut 40 through the retainer ring 20A and 20B to the flange 12 and to exert a clamping pressure between the two pieces of the retainer ring to maintain ground continuity between the two pieces and between the retainer ring and the nut. As the nut is turned, relative motion between the sloping annular surfaces breaks surface oxides and further enhances ground continuity therebetween. The retainer ring further comprises, in the connected configuration, a proximally extending sleeve 34 engaging the flange 12 with the interiorly threaded nut 40 screwed onto the exteriorly threaded portion 53 of the opening of the plug receptacle 50, while the plug is inserted within the plug receptacle with the proximally extending sleeve 34 bearing against the flange 12 to insure full insertion of the plug within the receptacle and maintain ground continuity between the proximally extending sleeve and the flange. As the proximally extending sleeve 34 begins to tighten against the flange 12, relative motion therebetween breaks surface oxides, thereby enhancing ground continuity therebetween.

The nut 40 further comprises a series of openings 41 around the exterior of the nut for engagement with a spanner wrench for turning the nut and also a series of peripheral notches 45 for manual turning.

Figure 3:
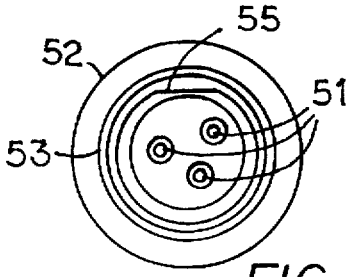
FIG. 3 is an end elevational view of the plug receptacle showing the receptacle opening.
Figure 4:
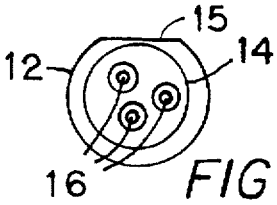
FIG. 4 is an end elevational view of the plug showing the contact pins.

In FIGS. 3 and 4, the flange 12 is configured with a flat portion 15 to form a D-shaped ridge and the plug receptacle has a D-shaped flange receiving opening 55 so that the plug contact pins 16 align with and engage the plug receptacle sockets 51.

In practice, the plug end 14 of the cable 10 is inserted through an opening in the x-ray equipment housing and the nut 40 is slipped over the plug end 14 and the flange 12. The bend relief sleeve 30 has been previously attached to the cable 10 adjacent to the flange 12 or actually formed around the cable. The two-piece retainer ring 20A and 20B is snap fit together around the bend relief sleeve 30 with the interior groove 25 of the retainer ring mating with the exterior ridge 31 of the bend relief sleeve 30. The nut 40 is then snap fit onto the assembled retainer ring. The plug end is inserted in the plug receptacle 50 with the D-shaped flange 12 mating with the D-shaped opening 55 to align the contact pins 16 of the plug end 14 with the sockets 51 of the plug receptacle 50. The nut 40 is threaded onto the threaded portion 53 of the plug receptacle. The nut 40 is free to rotate around the retainer ring which bears against the flange 12 insuring connection of the contact pins 16 with the sockets 51.

It is understood that the preceding description is given merely by way of illustration and not in limitation of the invention and that various modifications may be made thereto without departing from the spirit of the invention as claimed.

What is claimed is:

1. A snap-together high-voltage plug coupling nut assembly device for retaining a high voltage cable end plug in a threaded high-voltage plug receptacle with receiving sockets, wherein the device comprises:

a high-voltage cable having an end plug including conducting end pins insertable in the receiving sockets and a protruding flange between the cable and the end plug;

a two-piece retainer ring contacting the flange when assembled and having a snap-fit built-in self-retaining means built into the two-piece retainer ring for securing the two-piece ring together around the cable adjacent to the flange so that the retainer ring is self-retaining on the cable and free to rotate around the cable after snapping together around the cable, said retainer ring having a circular groove around an exterior thereof;

an annular nut having internal threads for engaging the plug receptacle, an interior circular opening sufficiently large so that the nut fits over the flange, and a spring means for snap-fitting in said groove and securing the retainer ring in said annular nut, the retainer ring rotatably within the nut so that the nut and the retainer ring form a snap-together coupling nut assembly and the nut is free to rotate relative to the retainer ring.

2. The device of claim 1 wherein the snap-fit built-in self-retaining means of securing the two-piece retainer ring together comprises a roll pin protruding from at least one piece of the two-piece retainer ring inserted in a tight friction snap fit within a mating hole in the other piece of the two-piece retainer ring.

3. The device of claim 2 wherein said spring means comprises a pair of spring wires inserted through opposing sides of the nut and protruding into the interior circular opening of the nut so that the spring wires form parallel chords within the circular opening and the spring wires engage the exterior circular groove of the retainer ring with a snap-fit allowing relative rotation of the nut and retainer ring.

4. The device of claim 3 further comprising a bend relief sleeve positioned between the retainer ring and the cable with the bend relief sleeve extending along a portion of the cable away from the retainer ring.

5. The device of claim 4 wherein the assembled retainer ring further comprises an interior circular groove and the bend relief sleeve further comprises an exterior circular ridge engaging the interior circular groove of the retainer ring so that the bend relief sleeve is secured to the retainer ring.

6. The device of claim 3 wherein the retainer ring further comprises, in an assembled configuration, a first protruding sloping annular surface around the exterior of the retainer ring and the nut further comprises a second protruding sloping annular surface around the interior of the nut so that the first and second annular surfaces mutually engage to exert pressure from the nut through the retainer ring to the flange, to exert a clamping pressure between the two pieces of the retainer ring maintaining ground continuity between the two pieces and between the retainer ring and the nut, and, with relative motion between the first and second annular surfaces as the nut is tightened, to cause a wiping action therebetween breaking surface oxides to enhance ground continuity therebetween.

7. The device of claim 6 wherein the retainer ring further comprises a proximally extending sleeve engaging the flange to insert the plug fully in the socket and insure ground continuity between the proximally extending sleeve and the flange and, upon tightening of the nut, relative motion of the proximally extending sleeve and the flange breaks surface oxides to enhance ground continuity therebetween.

8. The device of claim 3 wherein the nut further comprises a series of openings around the exterior of the nut for engagement with a spanner wrench for turning the nut.

9. The device of claim 3 wherein the flange is configured in a D-shaped ridge and the plug receptacle has a D-shaped flange receiving opening so that the plug contact pins align with and engage the plug receptacle sockets.

10. A snap-together high-voltage plug coupling nut assembly device for retaining a high voltage cable end plug in a threaded high-voltage plug receptacle with receiving sockets, wherein the device comprises:

a high-voltage cable having an end plug with conducting end pins insertable in the receiving sockets and a protruding flange between the cable and the end plug;

a two-piece retainer ring adapted for contacting the flange when assembled and having a means built into the two-piece retainer ring for securing the two-piece ring together with a mutually engaging snap together fit around the cable adjacent to the flange so that the retainer ring is self-retaining on the cable after snapping together around the cable;

an annular nut having threads for engaging the plug receptacle, an interior circular opening sufficiently large so that the nut fits over the flange, and a means for receiving and retaining, with a snap together fit allowing mutual rotation, the retainer ring rotatably within the nut so that the nut and the retainer ring form a snap-together coupling nut assembly and the nut is free to rotate relative to the retainer ring;

wherein the snap-fit built-in self-retaining means of securing the two-piece retainer ring together further comprises a roll pin protruding from at least one piece of the two-piece retainer ring inserted in a tight friction snap fit within a mating hole in the other piece of the two-piece retainer ring; and wherein the connected retainer ring further comprises a circular groove around the exterior of the retainer ring and the means for snap-fitting and securing the retainer ring rotatably within the nut comprises a pair of spring wires inserted through opposing sides of the nut and protruding into the interior circular opening of the nut so that the spring wires form parallel chords within the circular opening and the spring wires engage the exterior circular groove of the retainer ring with a snap-fit allowing relative rotation of the nut and retainer ring.

* * * * *